US007218283B2

(12) United States Patent
Nagel

(10) Patent No.: US 7,218,283 B2
(45) Date of Patent: May 15, 2007

(54) MOTOR-VEHICLE ANTENNA MOUNT

(75) Inventor: Stefan Nagel, Stuttgart (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 244 days.

(21) Appl. No.: 11/114,212

(22) Filed: Apr. 7, 2005

(65) Prior Publication Data

US 2005/0237249 A1 Oct. 27, 2005

(30) Foreign Application Priority Data

Apr. 8, 2004 (DE) ..... 10 2004 017 371

(51) Int. Cl.
*H01Q 1/32* (2006.01)

(52) U.S. Cl. ..... 343/711; 343/713

(58) Field of Classification Search ..... 343/711, 343/712, 713–715; 403/197, 252
See application file for complete search history.

(56) References Cited

U.S. PATENT DOCUMENTS 6,157,345 A * 12/2000 Hockett et al. ..... 343/715
6,509,878 B1 * 1/2003 Tornatta et al. ..... 343/715
6,930,643 B2 * 8/2005 Byrne et al. ..... 343/702
7,004,666 B2 * 2/2006 Kozlovski ..... 403/252
7,019,701 B2 * 3/2006 Ohno et al. ..... 343/715
7,046,207 B2 * 5/2006 Takahashi ..... 343/711
7,088,297 B2 * 8/2006 Nakano et al. ..... 343/713
2003/0197649 A1 * 10/2003 Kozlovski ..... 343/711
2006/0110214 A1 * 5/2006 Kozlovski ..... 403/252
2006/0130579 A1 * 6/2006 Dalla Piazza et al. ... 73/504.16

* cited by examiner

*Primary Examiner*—Trinh Vo Dinh
(74) *Attorney, Agent, or Firm*—Andrew Wilford

(57) ABSTRACT

A flat base plate sits atop a motor-vehicle panel and is formed with a mounting pin extending downward through the panel. A flat antenna circuit board sits on the base plate, and a connector cable extends upward through the pin and through the base plate and is connected to the circuit board. A one-piece mounting element is unitarily formed with an upper face and latch legs projecting upward from the upper face and having barb ends latchingly engageable with the circuit board to retain the circuit board on the upper face. It is further unitarily formed with a lower face and latch legs projecting downward from the lower face through the base plate and roof panel and having barb ends latchingly engageable with the roof panel to hold the circuit board and base plate down against the roof panel.

9 Claims, 8 Drawing Sheets

MOTOR-VEHICLE ANTENNA MOUNT

FIELD OF THE INVENTION

The present invention relates to an antenna mount. More particularly this invention concerns a mount for securing an antenna to a motor vehicle.

BACKGROUND OF THE INVENTION

As described in copending application Ser. No. 10/732,922 filed 10 Dec. 2003, an antenna assembly for mounting upon a wall of a vehicle body has a metallic base plate with a face adapted to be juxtaposed with the vehicle wall. A plastic housing encloses antenna elements mounted on the base plate. A seal between the plate-shaped portion and the wall seals the base plate relative to an interior of the vehicle body. A threaded mounting pin extends downward from the metallic base plate.

Here a cable extends through the base plate to the antenna elements, where it is normally soldered to traces of a circuit board. The circuit board in turn is formed with a plurality of holes matching threaded holes in the base plate so this circuit board can be secured in place by screws. Such mounting is fairly complex and requires quite a few parts. It therefore considerably elevates the cost of this mass-production item.

What is more the complex prior-art assembly often requires two people for installation. One must hold it in place atop the vehicle with its threaded mounting pin projecting down through the roof, while the other fits a washer and nut on this pin to secure it in place. This type of assembly further raises the installation costs for the device.

In the known devices an excessive pull on the cables extending from the circuit board down through the base plate can create problems. Since the cables are normally soldered directly to traces on the board, too much tension can rip them loose and even pull the traces off the board, ruining it beyond repair.

OBJECTS OF THE INVENTION

It is therefore an object of the present invention to provide an improved motor-vehicle antenna mount.

Another object is the provision of such an improved motor-vehicle antenna mount that overcomes the above-given disadvantages, in particular that is of relatively simple and inexpensive construction and that is relatively easy to install, even by one person.

A further object is to provide such a motor-vehicle antenna mount where the cables extending from the circuit board are solidly anchored in the assembly.

SUMMARY OF THE INVENTION

According to the invention a flat base plate sits atop a motor-vehicle panel and is formed with a mounting pin extending downward through the panel. A flat antenna circuit board sits on the base plate, and a connector cable extends upward through the pin and through the base plate and is connected to the circuit board. In accordance with the invention a one-piece mounting element is unitarily formed with an upper face and latch formations projecting from the upper face and latchingly engageable with the circuit board to retain the circuit board on the upper face. It is further unitarily formed with a lower face and latch formations projecting from the lower face through the base plate and roof panel and latchingly engageable with the roof panel to hold the circuit board and base plate down against the roof panel.

Thus this mounting element is clipped on one side to the circuit board and on the opposite side through the base plate to the vehicle panel, normally the roof, to secure the entire assembly together. No separate fasteners are used and, according to the invention the mounting element is plastic and the latching formations are oppositely extending sets of elastically deflectable arms having outer ends formed with barbs. The circuit board and base plate are formed with respective arrays of throughgoing holes through which the respective arms project.

The mounting element is formed offset from the arms with an outwardly projecting guide pin. The circuit board is formed with a throughgoing hole in which the guide pin is received when the respective latch formations are engaged with the circuit board. There is only one such guide pin and it is set to one side, so that it ensures that the mounting element will be installed in the desired orientation.

The mounting element is formed with a seat in which the cable is snugly engageable. This seat is so constructed that it guides the cable through a stress-relieving bend. In practice there are often two such cables and two such seats of different sizes. One or both of the seats can be formed with a cross-wise cable-gripping ridge. The mounting element thus serves as a strain relief for the cables. In fact it facilitates attachment of the cables to the antenna board, producing a subassembly that comprises the antenna board, the mounting element, and the cables that can be installed on the base plate and that can be handled, prior to installation on the base plate, without having to worry about the fragile connection of the cables to the antenna board.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
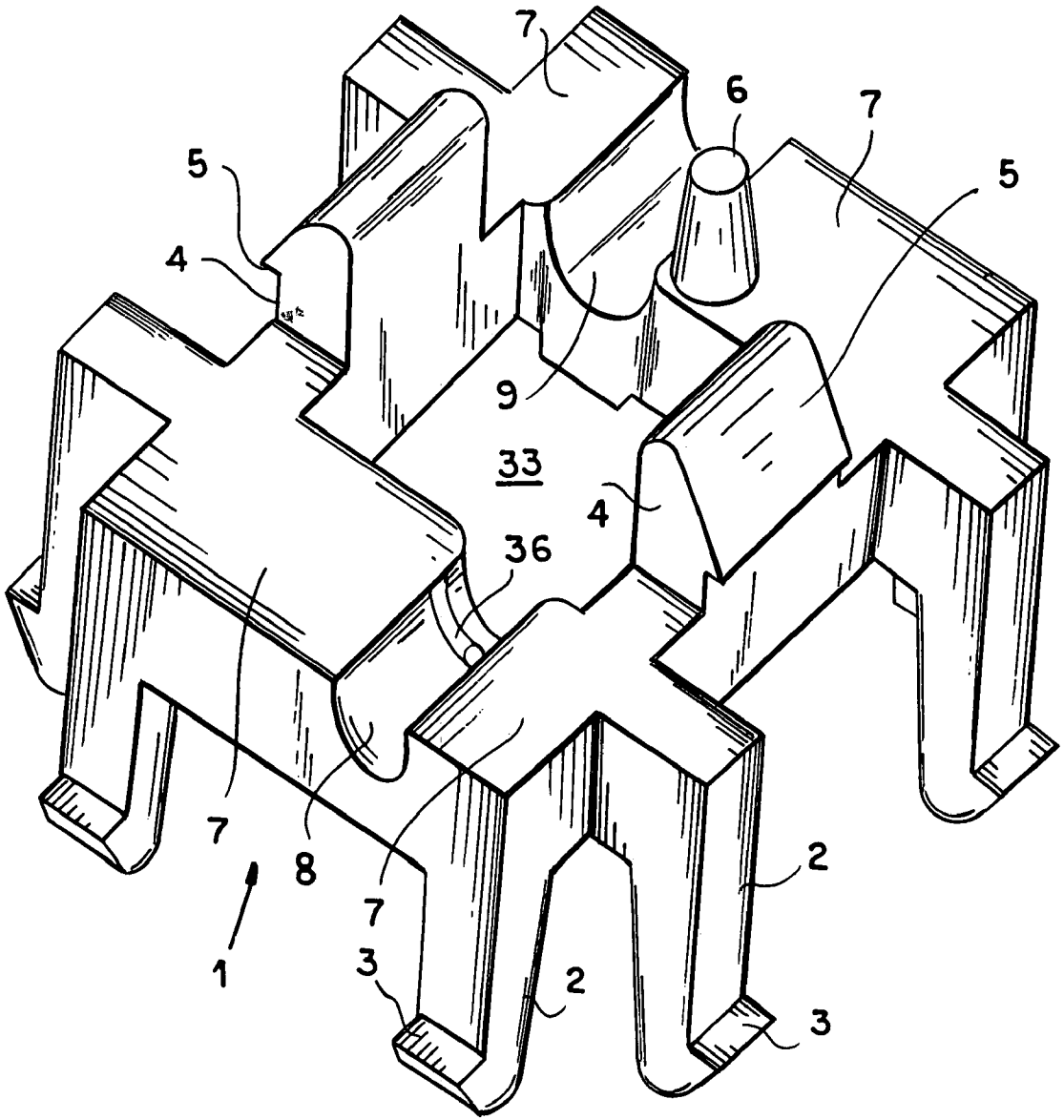
FIG. 1 is a perspective view from above of the mounting element according to the invention.

As seen in FIG. 1 a plastic injection-molded mounting element 1 is a generally rectangular annular frame centrally defining a throughgoing rectangular-section opening 33. It has on each side at the corners two normally downwardly extending legs 2 each having in turn an outwardly extending barb or tooth 3. The element 1 has an upwardly directed planar seat surface 7 from which two legs or projections 4 extend upward and an opposite downwardly directed planar bottom surface 34 that is parallel to the top surface 7. The projections 4 are parallel to each other on opposite sides of the central hole 33 and have oppositely and outwardly directed barbs or teeth 6. An upwardly tapered frustoconical centering pin 6 projects upward from the surface 7 to one side of the two projections 4. The entire element 1 is stiff but slightly elastically deformable. It is formed with two oppositely extending grooves 8 and 9 opening at the surface 7 and of different radii of curvature. One of the grooves 8 is shown to have a radially inwardly projecting cable-gripping ridge 36.

Figure 2:
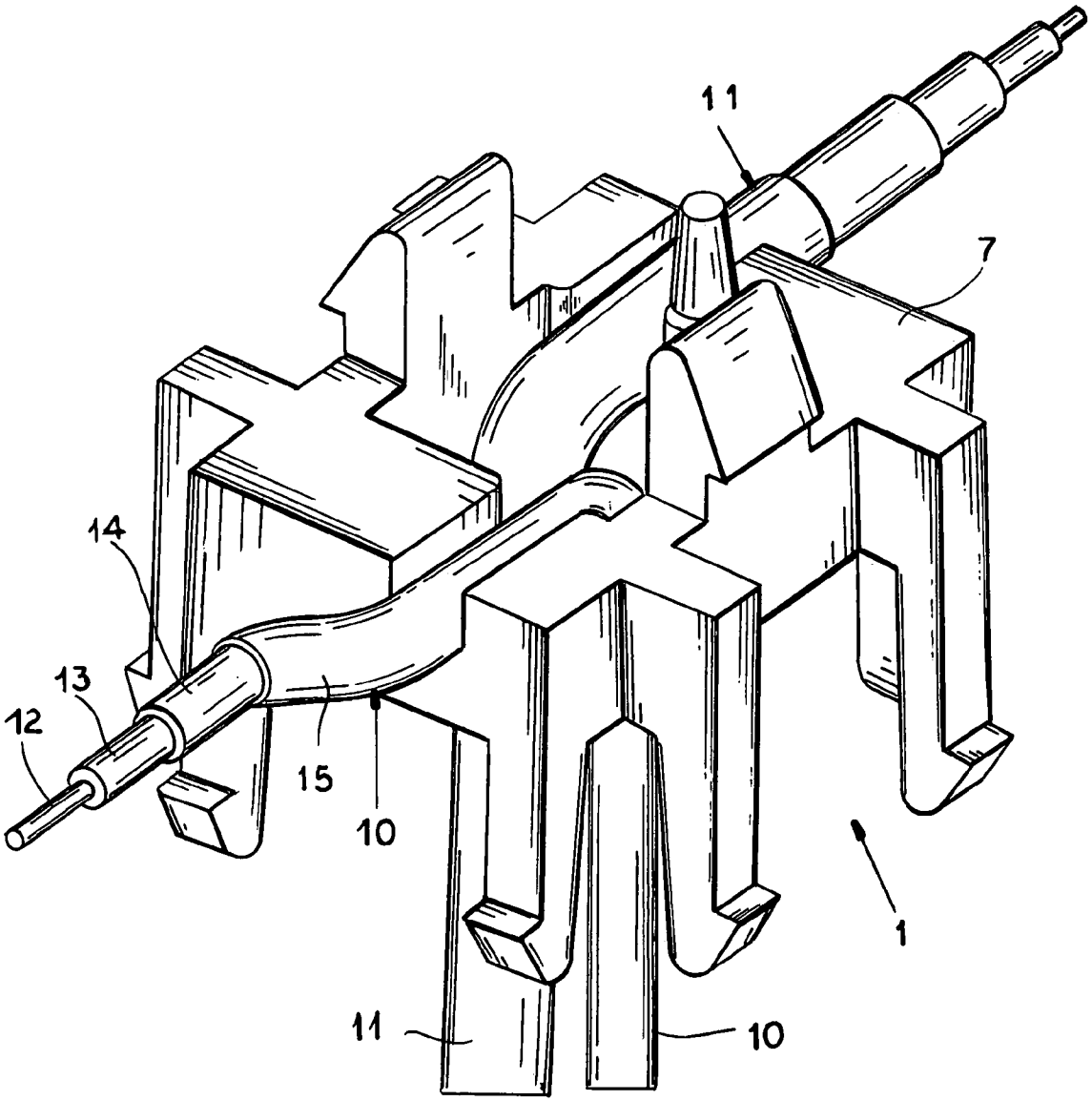
FIG. 2 shows the element with connector cables in place.

FIG. 2 shows two coaxial cables 10 and 11 fed up through the hole 33, bent through 90E, and then laid in the grooves 8 and 9. Each such cable 10 and 11 comprises a central core conductor 12, an insulating sleeve 13 around, a braid conductive shield sleeve 14 around the insulation 13, and a tubular insulating jacket 15 over the shield sleeve 14. The right-angle bend, the snug fit in the grooves 8 and 9, and even the ridge 36 biting into the cable 10, ensure that these cables 10 and 11 are solidly locked in the element 1. Thus a pull on the portion of the cable 10 or 11 hanging down from the hole 33 will be transmitted to the mounting element 1, not to the end of the cable 10 or 11 projecting parallel to the surface 7 from the element 1.

Figure 3:
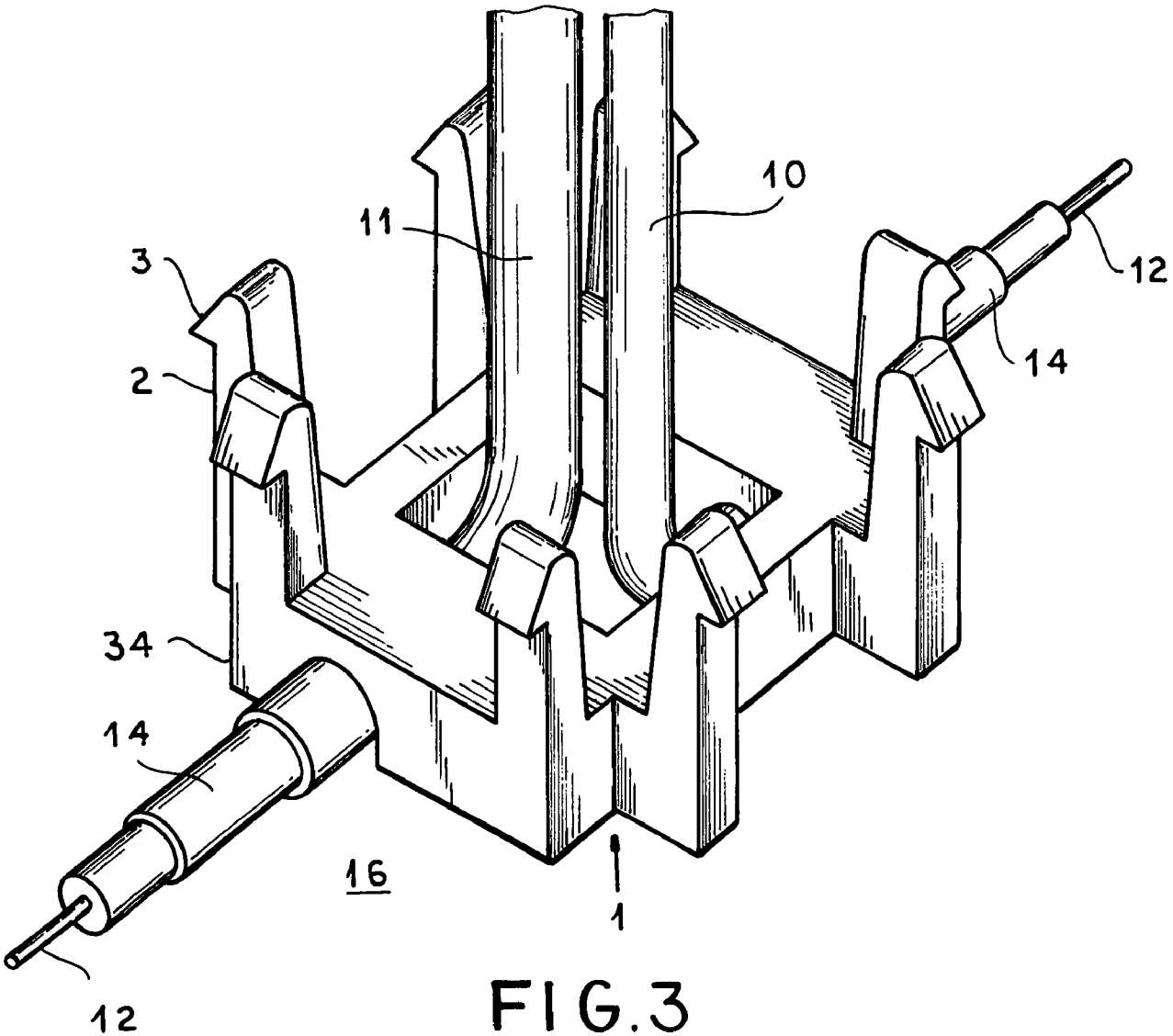
FIG. 3 is a bottom view of the structure of FIG. 3 mounted on a circuit board.
Figure 4:
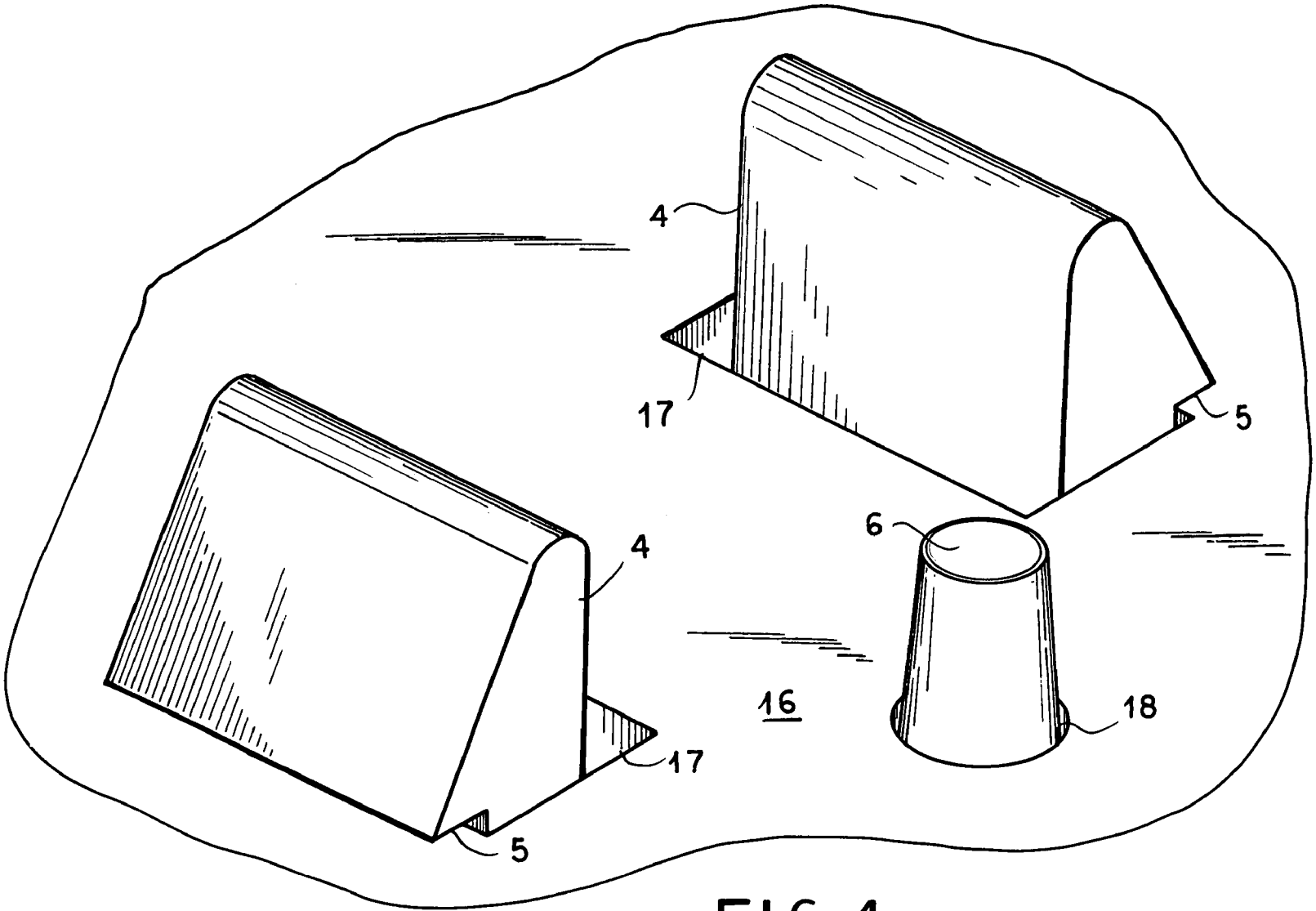
FIG. 4 is a large-scale top view of a detail of the structure of FIG. 3.

FIGS. 3 and 4 show how the element 1 with the two cables 10 and 11 is secured to the face of a planar antenna-circuit board 16, with the upper face 7 bearing flatly on the board 16 and its lower face 34 turned downward away from the board 16. To this end the two projections 4 extend through respective rectangular throughgoing holes 17 in the board and the barbs 5 snap out on the upper face of the board 16 and lock the element 1 to the board 16. The centering pin 6 fits through a hole 18 in the board 16 to ensure proper orientation of the element 1 on the board 16. The two cables 10 and 11 are compressed by the board 16 into the grooves 8 and 9 to provide excellent strain relief so that a pull on the cables 10 and 11 below the board 16 will not be transmitted through to the outer ends of the cables 10 and 11 to loosen them from the traces they are soldered or otherwise connected to. The antenna board 16, mounting element 1, and cables 10 and 11 together form a stable subassembly that can be handled using normal care without damaging it.

Figure 5:
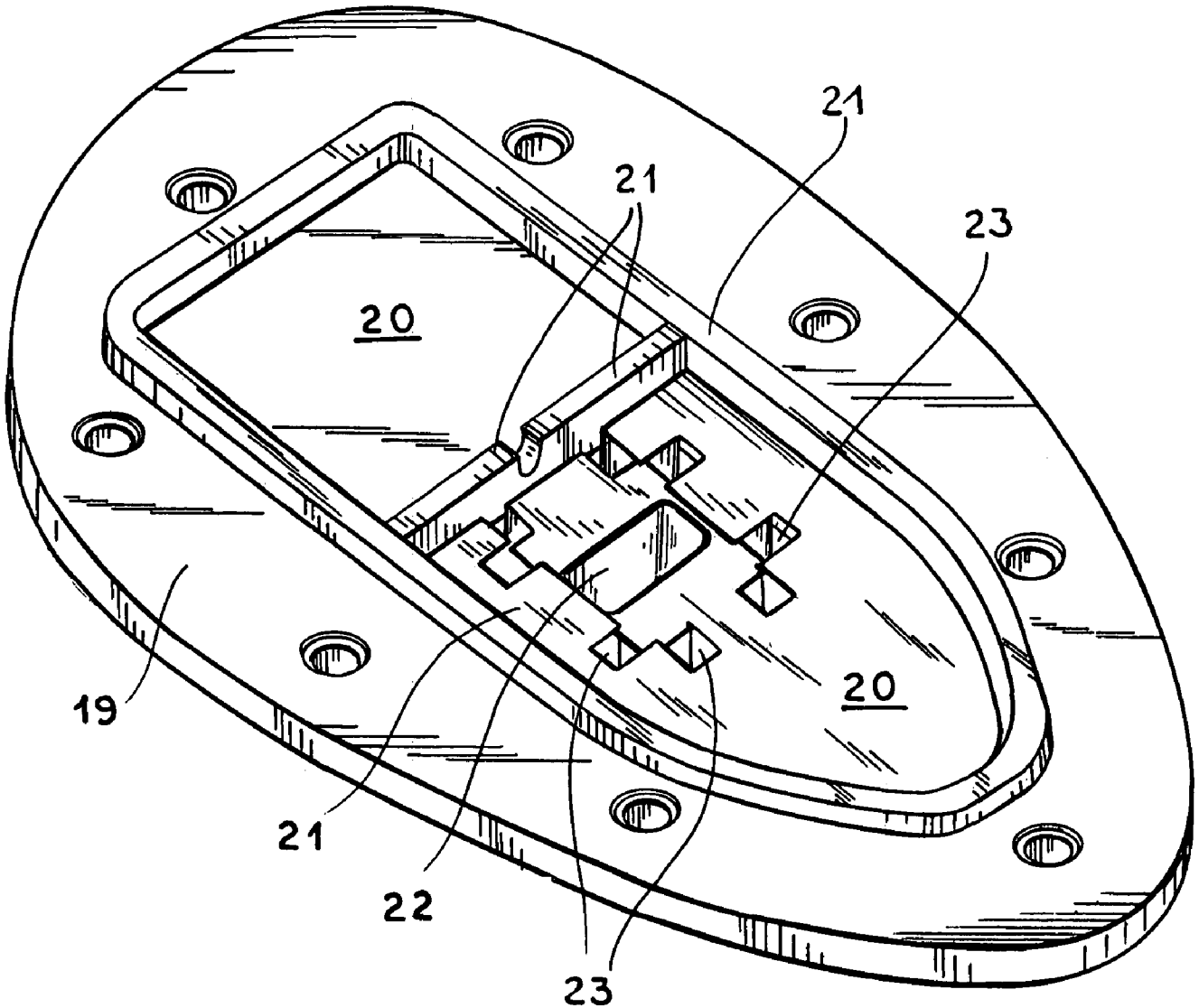
FIG. 5 is a top view of the base plate of the mount in accordance with the invention.
Figure 6:
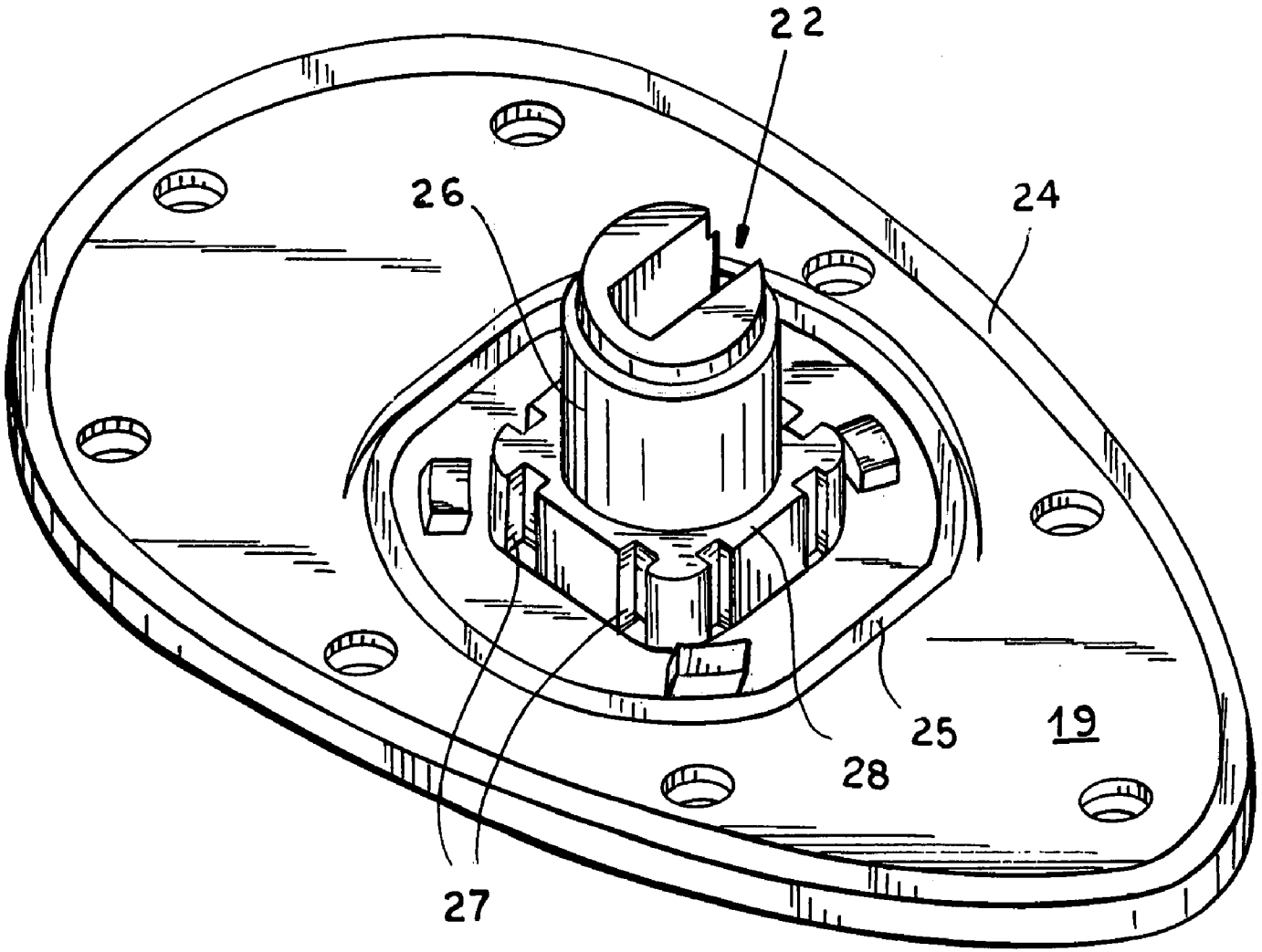
FIG. 6 is a bottom view of the base plate.

FIGS. 5 and 6 show a metallic base plate 19 having a planar upper seat surface 20 from which extend peripheral and crosswise rectangular-section ridges 21 intended to complementarily hold and receive the circuit board 16. The height of the ridges 21 is equal to the thickness of the element 1 between its faces 7 and 34. In addition this plate 19 is formed with eight holes 23 through which the legs 2 can fit and with a square central hole 22 identical to the hole 33 of the element 1. On its lower face the plate is unitarily formed with a downwardly projecting and externally threaded mounting pin 26 having a central throughgoing hole 22, with grooves 27 extending the holes 23 in a square downward projection 28 surrounding the pin 26 and ending in a lower flat surface 32 (FIG. 8). An annular inner seal 25 and an annular outer seal 24, both of elastically compressible plastic, are set in the bottom face of the plate 19. An annular array of mounting holes 31 is formed in the plate 10 between the seals 24 and 25 to allow the plate 19 to be screwed, if desired, to a roof panel shown schematically at 35 in FIG. 7. When the plate 19 is set on a complementarily flat surface of a motor-vehicle roof, these seals 24 will provide a double barrier against leakage.

Figure 7:
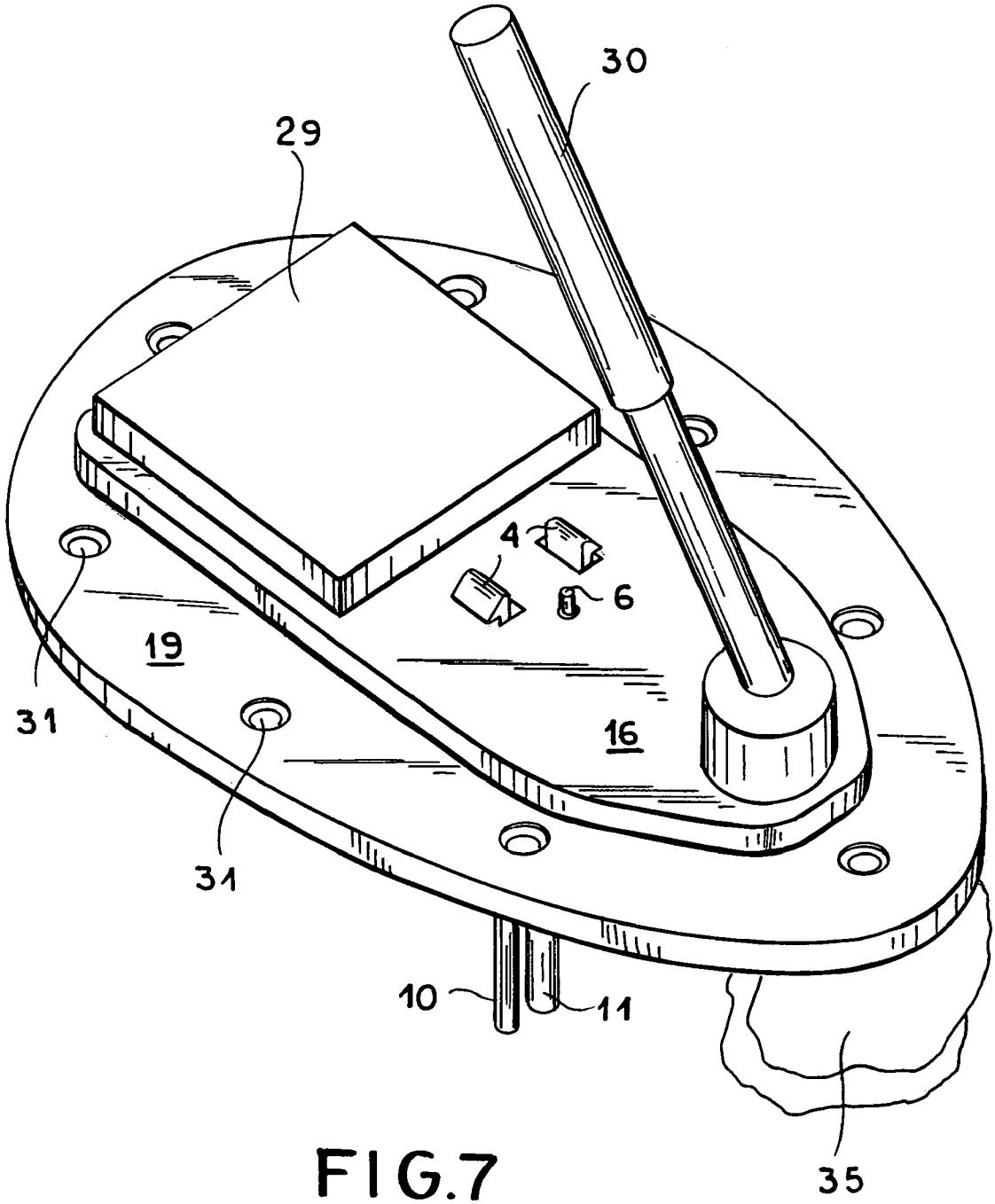
FIG. 7 is a top view of the base plate with the antenna module in place.
Figure 8:
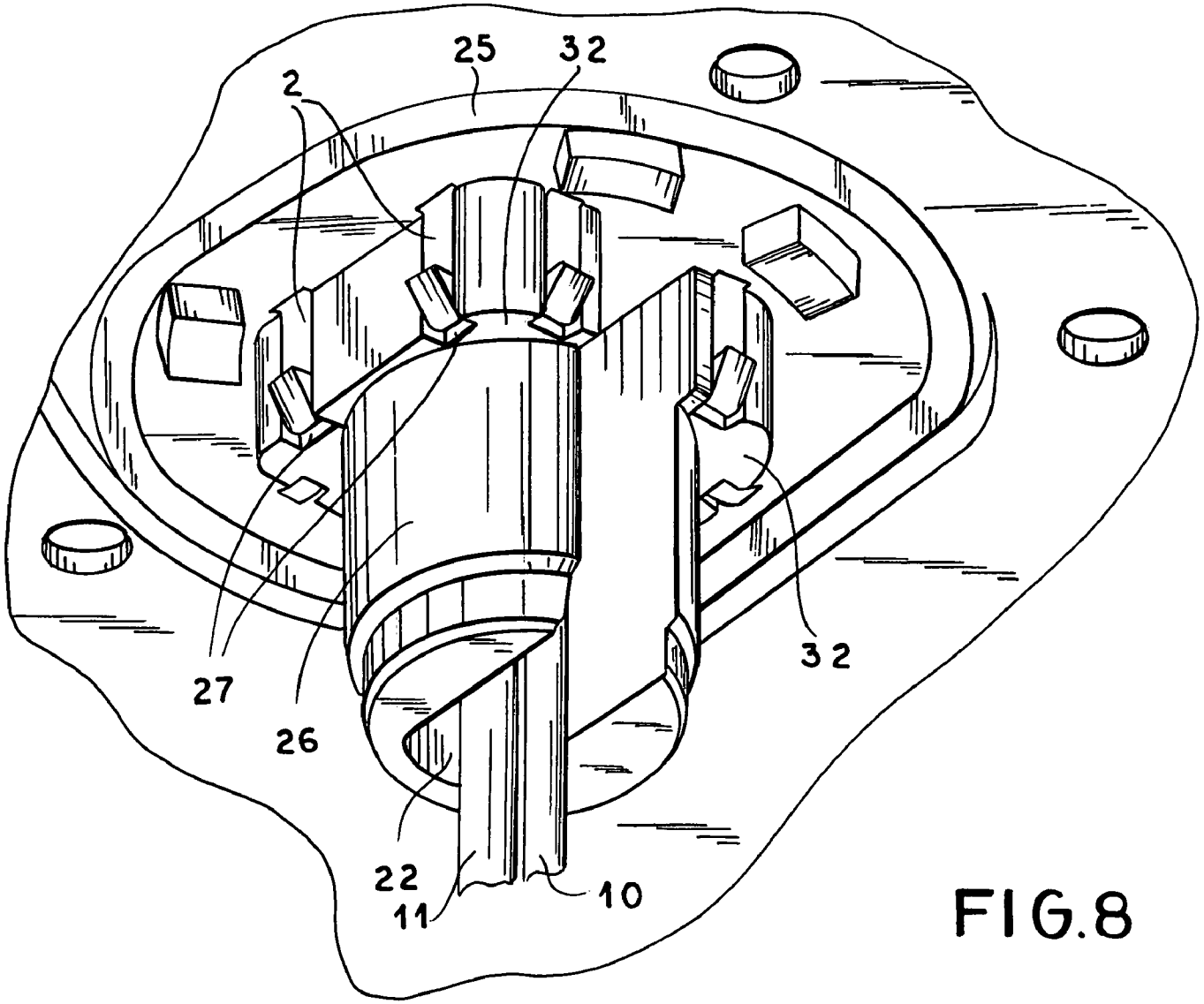
FIG. 8 is a large-scale bottom view of the structure of FIG. 7.

FIG. 7 shows how the antenna board 16 fits atop the plate 18, resting on the ridge 21 that will make a solid ground contact with a peripheral trace on an underside of the board 16. The upper face of the board 16 carries a GPS antenna 29 and a rod-type cell-phone antenna 30. Normally in fact the circuit board 16 is screwed or soldered to the plate 19 so that the board 16 and antennas 29 and 30 are shielded from below and a ground trace on the board 16 makes electrical connection with the normally metallic and conductive plate 19. Thus the subassembly of the antenna board 16, the mounting element 1, and the cables 10 and 11 is formed into a larger very solid subassembly including the base plate 19.

FIG. 8 shows the mount according to the invention from underneath, with the roof panel 35 not shown for clarity of view. The projection 28 fits through a complementary square hole in the roof panel 35 so that the barbs 3 can engage underneath the roof panel 35 and lock the entire assembly together and to the roof. One person can therefore easily snap the subassembly comprised of the board 16, mount 1, cables 10 and 11, and plate 19 into place on the roof, leaving it solidly held in place. If desired a nut and washer can be fitted over the pin 26 and screwed up against the lower face of the panel, but at least during assembly the legs 2 will hold the entire assembly together so that one person can do the installation. In addition if necessary the legs 2 can be pushed together to allow the antenna subassembly to be removed for servicing or replacement.

I claim:

1. In combination:

a motor vehicle roof panel;

a flat base plate sitting on the panel and formed with a mounting pin extending downward through the panel;

a flat antenna circuit board sitting on the base plate;

a connector cable extending upward through the pin and through the base plate and connected to the circuit board; and a one-piece mounting element unitarily formed with an upper face, latch formations projecting from the upper face and latchingly engageable with the circuit board to retain the circuit board on the upper face, a lower face, and latch formations projecting from the lower face through the base plate and roof panel and latchingly engageable with the roof panel to hold the circuit board and base plate down against the roof panel.

2. The combination defined in claim 1 wherein the mounting element is plastic.

3. The combination defined in claim 1 wherein the latching formations are oppositely extending sets of elastically deflectable arms having outer ends formed with barbs, the circuit board and base plate being formed with respective arrays of throughgoing holes through which the respective arms project.

4. The combination defined in claim 3 wherein the mounting element is formed offset from the arms with an outwardly projecting guide pin, the circuit board being formed with a throughgoing hole in which the guide pin is received when the respective latch formations are engaged with the circuit board.

5. The combination defined in claim 1 wherein the mounting element is formed with a seat in which the cable is snugly engageable.

6. The combination defined in claim 5 wherein the seat is so constructed that it guides the cable through a stress-relieving bend.

7. The combination defined in claim 5 wherein there are two such cables and two such seats of different sizes, Depending on the size of the mounting element of course it is possible to have more than two such cables and an anelogical number of such seats of different or the same size.

8. The combination defined in claim 5 wherein the seat is formed with a cross-wise cable-gripping ridge.

9. An antenna assembly for installation on a motor-vehicle roof panel, the antenna assembly comprising:

a flat base plate sitting on the panel and formed with a mounting pin extending downward through the panel;

a flat antenna circuit board sitting on the base plate;

a connector cable extending upward through the pin and through the base plate and connected to the circuit board; and a one-piece mounting element unitarily formed with an upper face, laterally deflectable latch legs projecting upward from the upper face and having barb ends latchingly engageable with the circuit board to retain the circuit board on the upper face, a lower face, and laterally deflectable latch legs projecting downward from the lower face through the base plate and roof panel and having barb ends latchingly engageable with the roof panel to hold the circuit board and base plate down against the roof panel.

* * * * *